US006904733B2

(12) United States Patent
Boix Jaen

(10) Patent No.: US 6,904,733 B2
(45) Date of Patent: Jun. 14, 2005

(54) MACHINE FOR PACKING BOTTLES IN CARDBOARD BOXES

(75) Inventor: José Boix Jaen, Albatera (ES)

(73) Assignee: Boix Maquinaria, S.A., Albatera (ES)

( * ) Notice: Subject to any disclaimer, the term of this patent is extended or adjusted under 35 U.S.C. 154(b) by 0 days.

(21) Appl. No.: 10/640,293

(22) Filed: Aug. 13, 2003

(65) Prior Publication Data

US 2004/0031236 A1 Feb. 19, 2004

Related U.S. Application Data

(63) Continuation of application No. PCT/ES02/00564, filed on Nov. 28, 2002.

(30) Foreign Application Priority Data

Dec. 14, 2001 (ES) ..... 200102781

(51) Int. Cl.[7] ..... B65B 21/24

(52) U.S. Cl. ..... 53/48.8; 53/209; 53/230; 53/377.6; 53/387.1

(58) Field of Search ..... 53/48.6–48.9, 53/228, 230, 376.3, 377.6, 387.1, 398, 207, 209, 462

(56) References Cited

U.S. PATENT DOCUMENTS 3,037,334 A * 6/1962 Chidsey, Jr. et al. ..... 53/48.8
3,516,219 A * 6/1970 Nigrelli et al. ..... 53/48.7
3,739,545 A * 6/1973 Lattke ..... 53/462
3,782,071 A * 1/1974 Hagedorn ..... 53/574
3,986,319 A * 10/1976 Puskarz et al. ..... 53/447
4,242,949 A * 1/1981 Auckenthaler ..... 493/295
4,414,789 A * 11/1983 Pattarozzi ..... 53/566
4,571,916 A * 2/1986 Meuwly et al. ..... 53/48.7
4,581,005 A * 4/1986 Moen ..... 493/167
4,689,934 A * 9/1987 Ganz ..... 53/398
4,708,706 A * 11/1987 Doderer et al. ..... 493/295
4,926,615 A * 5/1990 Alexander ..... 53/564
4,932,930 A * 6/1990 Coalier et al. ..... 493/128
5,148,654 A * 9/1992 Kisters ..... 53/462
5,352,178 A * 10/1994 Pazdernik ..... 493/316
6,505,458 B1 * 1/2003 Corniani et al. ..... 53/462

FOREIGN PATENT DOCUMENTS

ES 2003382 A * 11/1988
ES 2025895 A * 4/1992 ..... B65B/49/08

* cited by examiner

*Primary Examiner*—Stephen F. Gerrity
(74) *Attorney, Agent, or Firm*—Klauber & Jackson

(57) ABSTRACT

A machine is used for packing bottles by assembling cardboard boxes starting from an unfolded sheet (2) with adhesive strips, in such a way that in an initial step the bottles (6) to be packed are placed on a central part of the unfolded sheet of the box, a central part that will correspond with the bottom of the box. Once the bottles have been put on this central part of the unfolded sheet (2), in a downward movement, the sheet will encounter a funnel-shaped structure (14), whose mouth and due to the weight of the bottles (6), causes the box (8) to be partially assembled, introducing itself inside this funnel-shaped structure (14), resting at its bottom on a movable platform coupled on longitudinal guides (16). Once the initial and main assembly have been carried out, the total folding of the side walls and then the assembly of the mouth of the box will be carried out in subsequent phases, and finally the assembled box with the bottles inside will be ejected by a pusher (40)

12 Claims, 9 Drawing Sheets

MACHINE FOR PACKING BOTTLES IN CARDBOARD BOXES

RELATED APPLICATIONS

The present application is a Continuation of co-pending PCT Application No. PCT/ES02/00564 filed Nov. 28, 2002, which in turn, claims priority from Spanish Application No. 200102781 filed Dec. 14, 2001. Applicants claim the benefits of 35 U.S.C. §120 as to the PCT application and priority under 35 U.S.C. §119 as to the said Spanish application, and the entire disclosures of both applications are incorporated herein by reference in their entireties.

OBJECT OF THE INVENTION

Invention consists of a machine for packing bottles in cardboard boxes which is of the type that receive, by means of a feeding device, bottles that are conveyed and introduced by a conveyor belt, inside of which the bottles are selected by groups and conveyed towards a container or box forming area. The product to be packed could be any other one other than bottles.

The packing capacity of the machine is determined by means of the use of two symmetric container forming stations, in such a way that a single conveyor belt makes two packing areas or stations operate, in such a way that production is doubled, without the need of providing the machine with a double structure, since both forming stations share devices.

Another particularity of the invention is that the forming of the container or box is carried out progressively starting with an unfolded sheet forming the container, in such a way that the machine carries out the folding of that sheet forming the container, folding that begins, once each group of bottles has been automatically placed in an initial phase on a part of that unfolded sheet which will constitute the bottom of the container once same has been assembled.

This forming process of the container, once the group of bottles has been placed on the corresponding part of the unfolded sheet, prevents the labels recently glued on the bottles from moving due to some type of friction with the different forming devices and elements.

Therefore, the packing process of each group of bottles is started by placing the same on the central part of the unfolded sheet, part which will constitute afterwards the bottom of the container once it has been assembled, in such a way that the rest of the phases will be centered on the assembly of the container without the group of bottles undergoing relative movement with respect to the container itself.

BACKGROUND OF THE INVENTION

Some machines for packing bottles in cardboard boxes include a packing process, where such boxes have been previously assembled, or at least partially, in such a way that the machine introduces the bottles inside these boxes. Afterwards the boxes are closed entirely either by covers or by means of collapsing and folding some laps.

Other machines carry out the partial assembly first and then the above-cited process is repeated starting with the introduction of the bottles inside the boxes and ending with the closing thereof.

In these cases, the packing processes require at least a stage of partial assembly of the container or box, a stage for introducing the bottles inside the partially assembled box and a subsequent stage of closing said box.

There are other machines, on the other hand, that wrap the goods by means of forming a box (Spanish patent publication No. ES-2025895) or by means of supplying material in continuous strips (Spanish patent publication No. ES-2003382).

Spanish patent publication number ES-2025895 especially interests us more, and is a patent where the goods, such as jars, bottles and the like are wrapped by a stamped sheet of cardboard that, during the different stages of the machine, will carry out the assembly of the box wrapping the articles, which will finally remain inside the totally closed container.

The machine of this patent of invention has a single box forming station.

DESCRIPTION OF THE INVENTION

The machine for packing bottles in cardboard boxes is characterized in principle in that it includes at least two box forming stations, in such a way that a single conveyor belt makes two packing areas or stations operate, in such a way that production is doubled without the need of providing the machine with a double structure, since both packing stations share several devices.

This particular characteristic of doubling the box forming stations does not exist in conventional machines, in such a way that with the new machine greater production of packing will therefore be obviously obtained.

Besides, the structure, the device and the different elements that the machine also has are new, as it will be described hereinafter.

Hence, by means of a feeding device, the bottles are conveyed and introduced by a conveyor belt, inside of which the bottles are selected by groups and conveyed towards the two symmetric forming stations of the respective boxes.

Each group of bottles to be packed is placed on a central part of a cardboard sheet that has been previously placed on a frame that forms part of a descending device. This central part will constitute the bottom or bottom base of the box once it has been assembled.

In a subsequent phase, this frame, along with the cardboard sheet and bottle, descend towards the cardboard sheet that makes contacts with the mouth elements of a funnel-shaped structure, the mouth being larger than the bottom of the box.

With this operation, the assembly of the box and group of bottles and due to the weight thereof, descend due to gravity passing by the funnel-shaped structure that partially assembles the box with respect to the side walls and bottom thereof.

Previously, a movable platform advances along some parallel longitudinal guides, a platform where the base or bottom of the partially assembled box sits.

In a subsequent phase, some forming devices of the side walls of the box approach each other in a first and second approximation, in such a way that said forming devices will press the sides of the container, adapting thereto, in such a way that the movable parts thereof can collapse and fold the front ends of the container.

Once the front ends have been folded, some small lugs that collapse towards the inside and gently fold some end laps that form part of the closure of the mouth of the box or container, said lugs being coupled in one part of these folding devices.

Simultaneous to the movement of the lugs, the folding of other bottom end laps, that originate from the bottom of the box and that abut externally to the front ends, is carried out. This final folding is carried out by means of other movable parts that form part of the movable platform, parts that also fasten the container at the bottom in order to improve the conveyance thereof in subsequent movements.

In a subsequent phase, the different elements of the forming device return to their initial position. Afterwards these elements also move transversally up to their original position.

Then, an arm mechanism carries out the collapsing of a first larger lap that forms part of the closure of the mouth of the container. Then, the box will be conveyed like a funnel up to an advanced position along the longitudinal guides until a position where a total closing device will collapse a second larger lap of the mouth of the box that will be glued to the first above-cited lap, is reached.

For this purpose, this device comprises a jointed central plate that actuates the second larger lap. Afterwards, some jointed end folding elements that form part of said device carry out the collapsing downward of some tongues that will abut against the top part of the front ends of the box, thus completing the total assembly and closure of the box.

The box has been previously glued in its unfolded position by means of some adhesive strips so that the box once it has been assembled acquires the required consistency.

On the other hand, the possibility of including some centering devices has been provided for in order to place and convey each group or groups of bottles until they are placed on the unfolded sheets in the initial phase.

In a first option, the centering and placement device simply consists of a U-shaped support.

In a second option, the device consists of a conveyor support that picks up the group of bottles by their respective necks, at the same time that it clamps them. This device is more effective than the prior one, permitting the bottles to be placed in any manner.

The boxes obtained can have any other shape. For this purpose, it would merely be necessary to make some simple changes in the devices and elements of the machine.

In general, the movements of the different movable elements and devices is generally carried out by means of small pneumatic cylinders, although any other suitable means could be used.

Hereinafter to provide a better understanding of this specification and forming an integral part hereof, some figures in which the object of the invention has been represented in an illustrative and non-restrictive manner, are attached hereto.

DESCRIPTION OF THE PREFERRED EMBODIMENT

Figure 1:
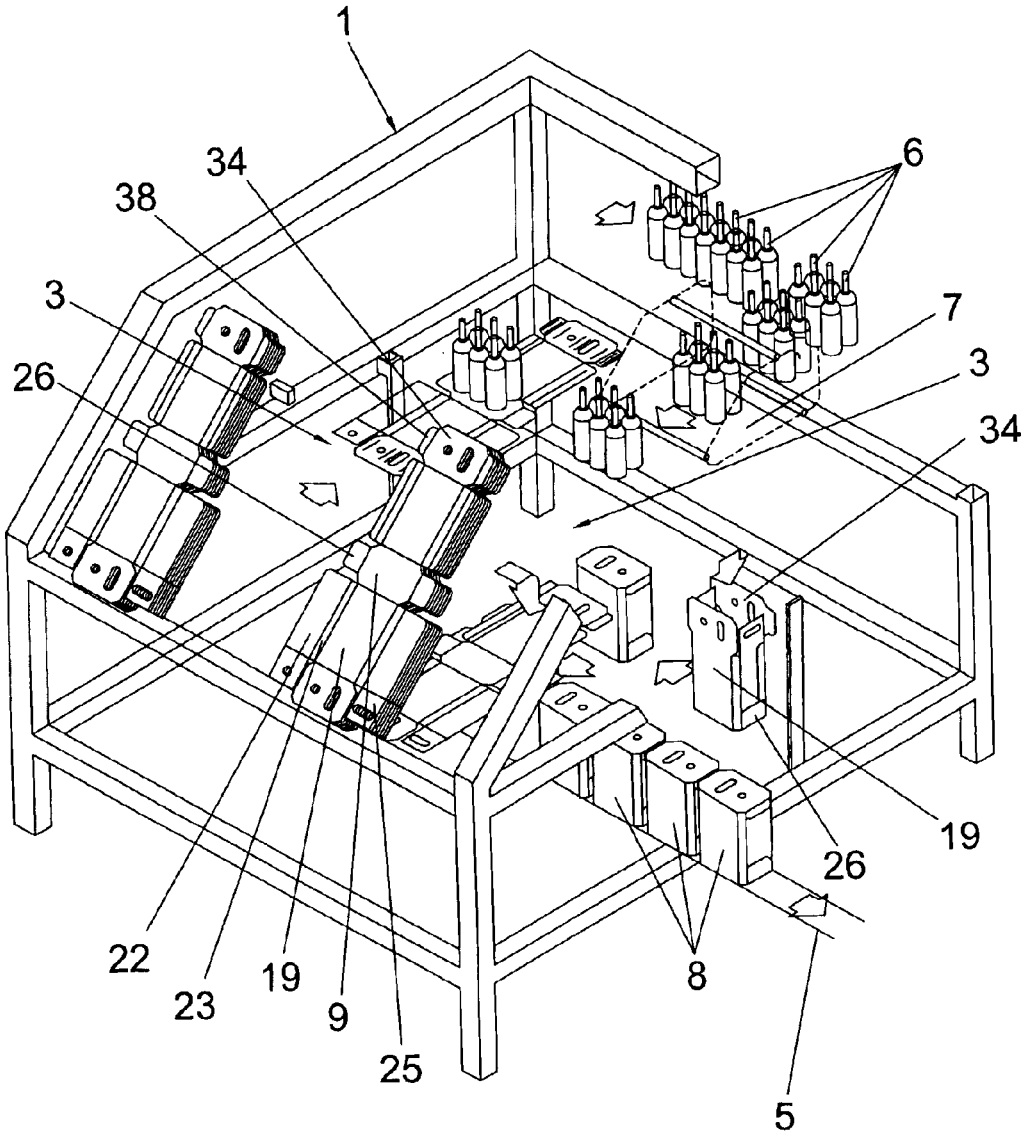
FIG. 1 shows a perspective view of the assembly of the machine for packing bottles in cardboard boxes, object of the invention.

An embodiment of the invention is described hereinafter using the numbering adopted in the figures.

In principle the machine includes a metallic structure (1) that supports two conventional cardboard sheet (2) feeding devices, cardboard sheets which are stacked on the respective inclined planes, in such a way that by means of said feeding devices not represented in the figures. The sheets (2) are conveyed up to some initial areas (3) of the machine placed in correspondence with some descending devices (4) where said sheets (2) will be placed on horizontal planes.

The machine also includes a conventional bottle (6) feeding device, bottles which will be conveyed and introduced by a conveyor belt (7) inside of which the bottles are selected by groups that are then conveyed towards the initial container or box (8) forming area (3), said groups corresponding to each one of the two descending devices (4).

Hence, once each one of the unfolded sheets (2) of the cardboard boxes (8) in the initial area (3) is placed in correspondence with the respective device (4), a group of bottles (6) is placed by conveyance on a central part (9) of the unfolded sheet (2), said central part corresponding with the bottom or base of the boxes (8).

In this situation, the unfolded sheet (2) rests, at the central part (9) that supports the bottles (6), on a horizontal U-shaped frame (10) that forms part of the descending device (4) and that will be conveyed downward by means of a pneumatic cylinder (11), in such a way that in this descent, the unfolded sheet (2) makes contact by its side walls with several forming elements (12) and (13) of a mouth belonging to a funnel-type structure (14). In this situation, the weight of the bottles (6) causes the sheet (2) to be partially assembled passing together with the group of bottles (6) through the funnel-shaped structure (14) up to a bottom position where the side walls of the box (8) remain partially assembled along with the bottom (9), walls that will sit on a movable conveyor platform (15) carried on some longitudinal guides (16). In this situation the box will remain inside the funnel-shaped structure (14).

The funnel-shaped structure (14) is adjustable and basically comprises two horizontal parallel strips (17), structure where other downward vertical strips (18) are connected, strips which in turn extend upward in some small inclined extensions (12), which together with other end pieces (13) constitute the above-mentioned mouth forming elements, which constitute the mouth itself. The frame (10) where the unfolded sheet (2) rests in its descent passes between said strips (17) and (18). Furthermore, it should be pointed out that the sides or larger side walls (19) of the box are arranged in correspondence with said strips (17) and (18).

In a subsequent phase, some forming devices (20) of the side walls of the box approach each other in a transversal direction in a first approximation, along both sides of the longitudinal guides (16) in order to collaborate with the elements (12) and (13) forming the mouth of the funnel-shaped structure (14) during the descent process of the box (8).

When the box has reached its bottom position with its base (9) resting on the movable platform (15), the forming devices (20) carry out a second approximation, this time pressing the sides of the container adapting to them, in a such a way that a movable part (21) in the manner of a hinged door of these devices (20) can collapse and fold the front ends (22) of the box (8) together with other narrow corner extensions (23).

Once the front ends (22) are folded some small lugs (24) are actuated, lugs which collapse towards the inside and gently fold some top end laps (25) that form part of the closure of the mouth of the container (8). Said lugs (24) articulate in the movable part (21) of the side forming devices (20).

Simultaneous to the movement of the lugs (24), the folding of other bottom end laps (26) that originate in the bottom (9) of the box (8) and that abut externally to the front ends, is carried out. This final folding is carried out by means of other movable parts (27), also in the manner of hinged doors, that form part of the movable forming platform (14) conveyed along the longitudinal guides (16). These movable parts (27) also fasten underneath the container (8) in order to improve its conveyance in subsequent movements along the longitudinal guides (16).

In this subsequent phase, the different elements of the forming devices (20) return to their initial position and afterwards these elements then move transversally up to their original position.

Then, an arm device or mechanism (28) carries out the folding of the first larger lap (29) that forms part of the closure of the mouth of the container (8). One of these arms (30) is basically responsible for the collapsing whereas the other elbowed arm (31) prevents the larger lap (29) from rising when the container (8) is conveyed towards the following forming station where a device (32) that totally closes the mouth of said container (8) will actuate. This conveyance will be carried out by the movable platform (15) conveyed on the longitudinal guides (16). This arm mechanism (28) includes a rotating longitudinal rod (33) and two arms integral to the rod: a front one (30) and the other one elbowed (31).

During the conveyance of the box (8) a second larger lap (34) begins to collapse by means of a top and intermediate folded guide (35) that remains static, in such a way that once the box (8) reaches the last forming station, the total closing device (32) will actuate the second larger lap (34).

For this purpose, this device (32) comprises a central jointed plate (36) that actuates the second larger lap (34), the second lap abutting against the first larger lap (29). Then, some end folding elements (37) jointed to that central plate (36) collapse downward towards some tongues (38) that will abut against the top part of the front ends (22) of the box (8), thus complementing the total assembling and closing of thereof.

Figure 2:
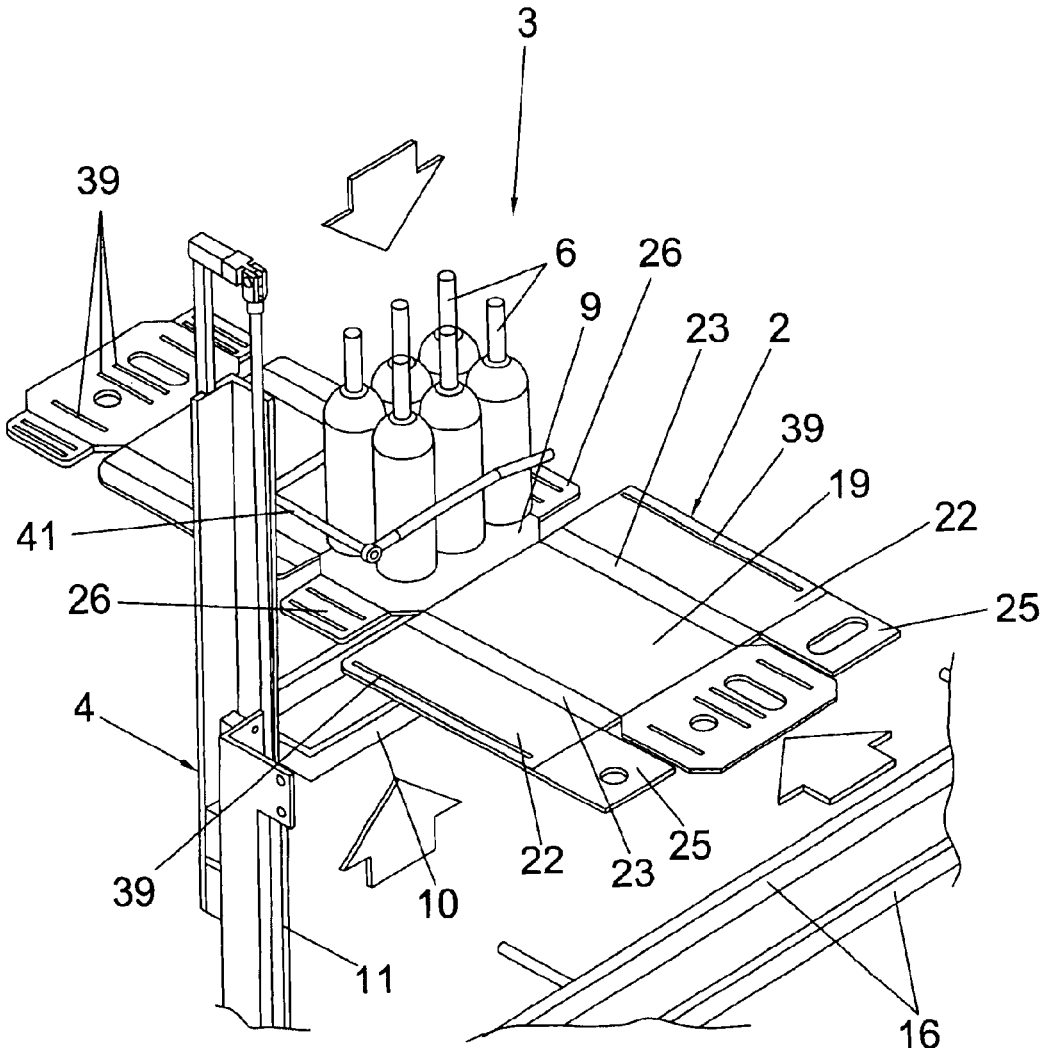
FIGS. 2 to 6 show the different stages or steps for packing the bottles inside the cardboard boxes, in such a way that starting with a cardboard stamped sheet and resting at least one group of bottles on a central part of said sheet constituting said central part of the bottom of the box, the machine carries out the closing of said box in different phases keeping the bottles at all times resting on the central part of the unfolded sheet.
Figure 3:
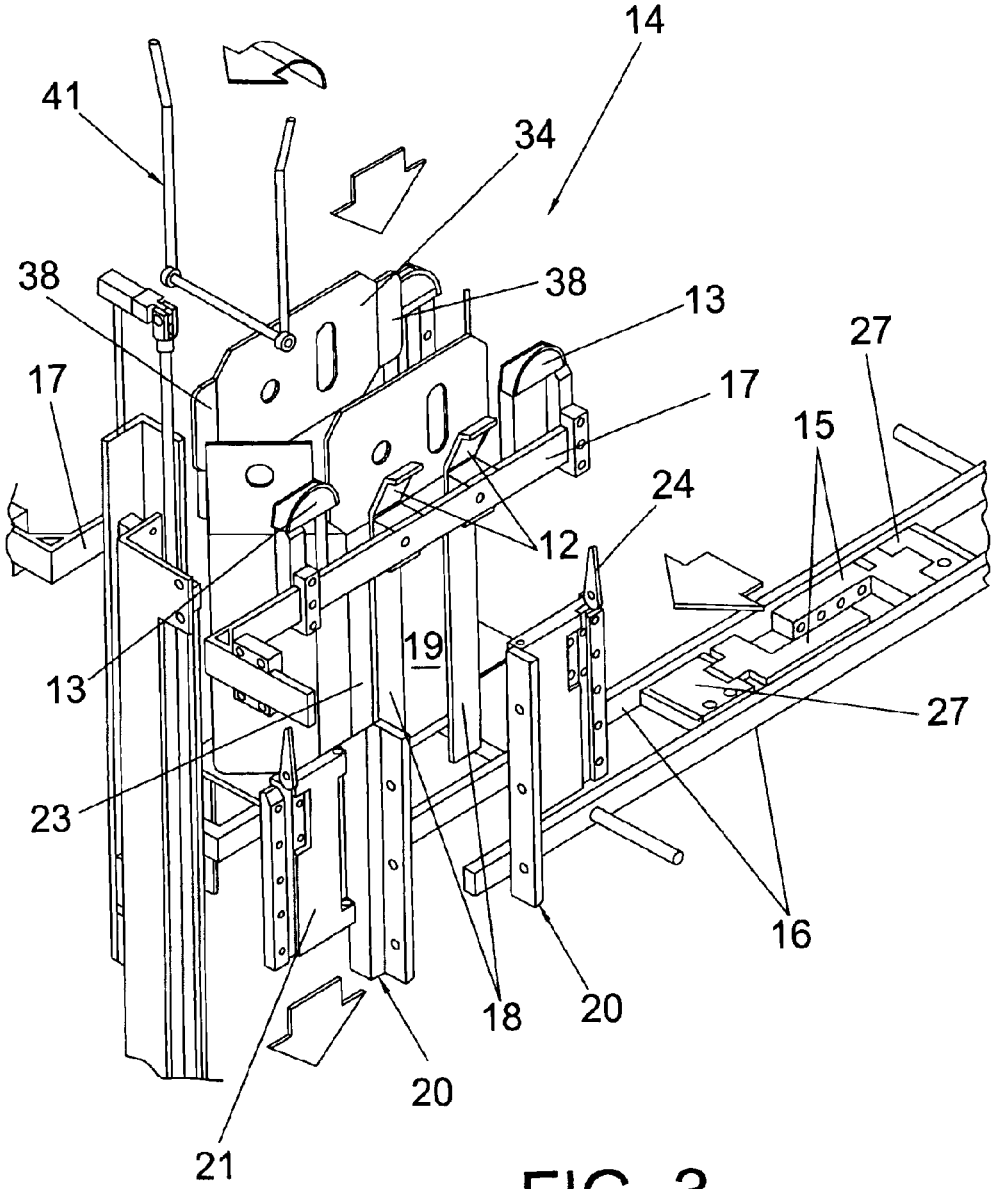
Figure 4:
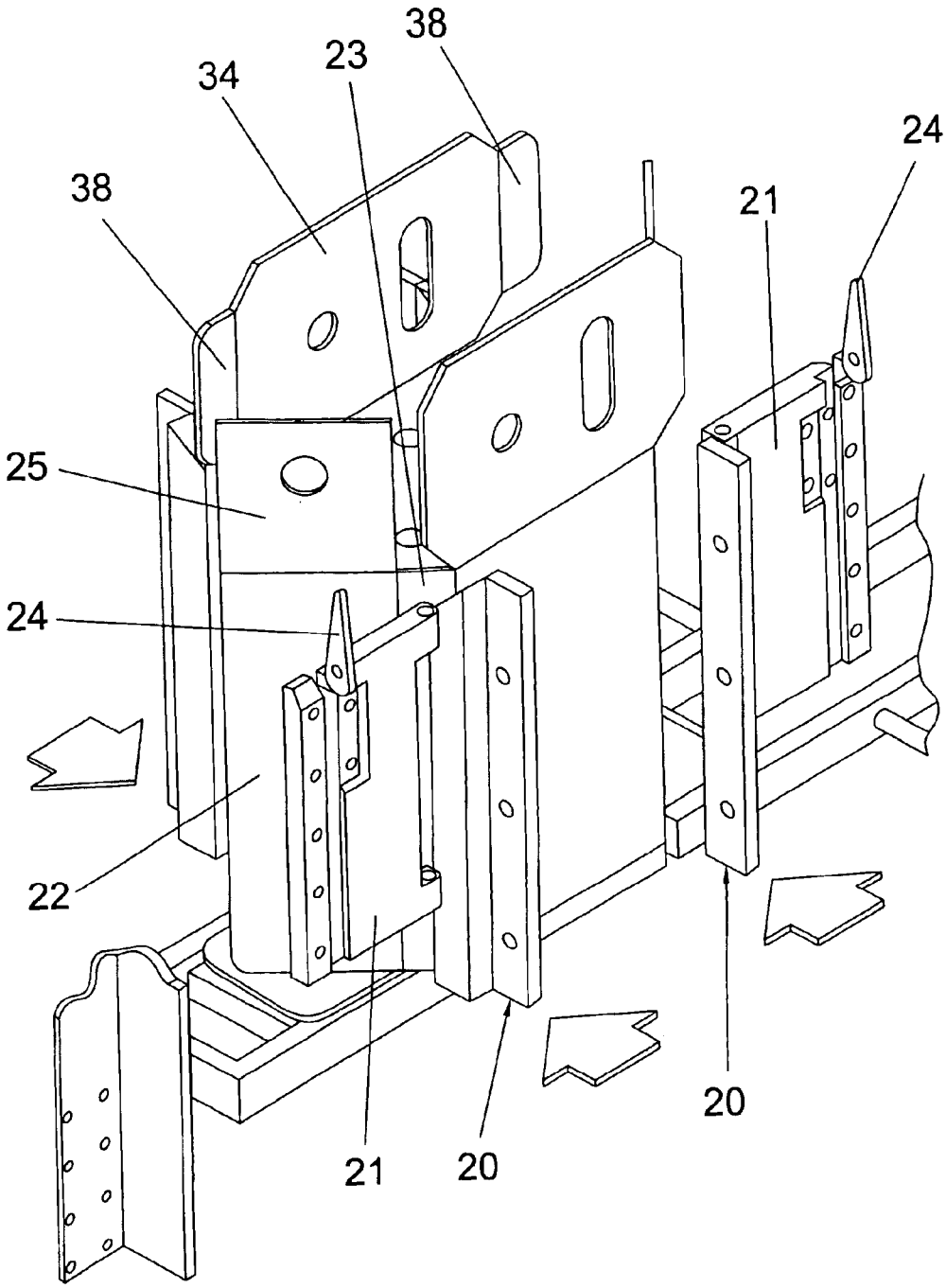
Figure 5:
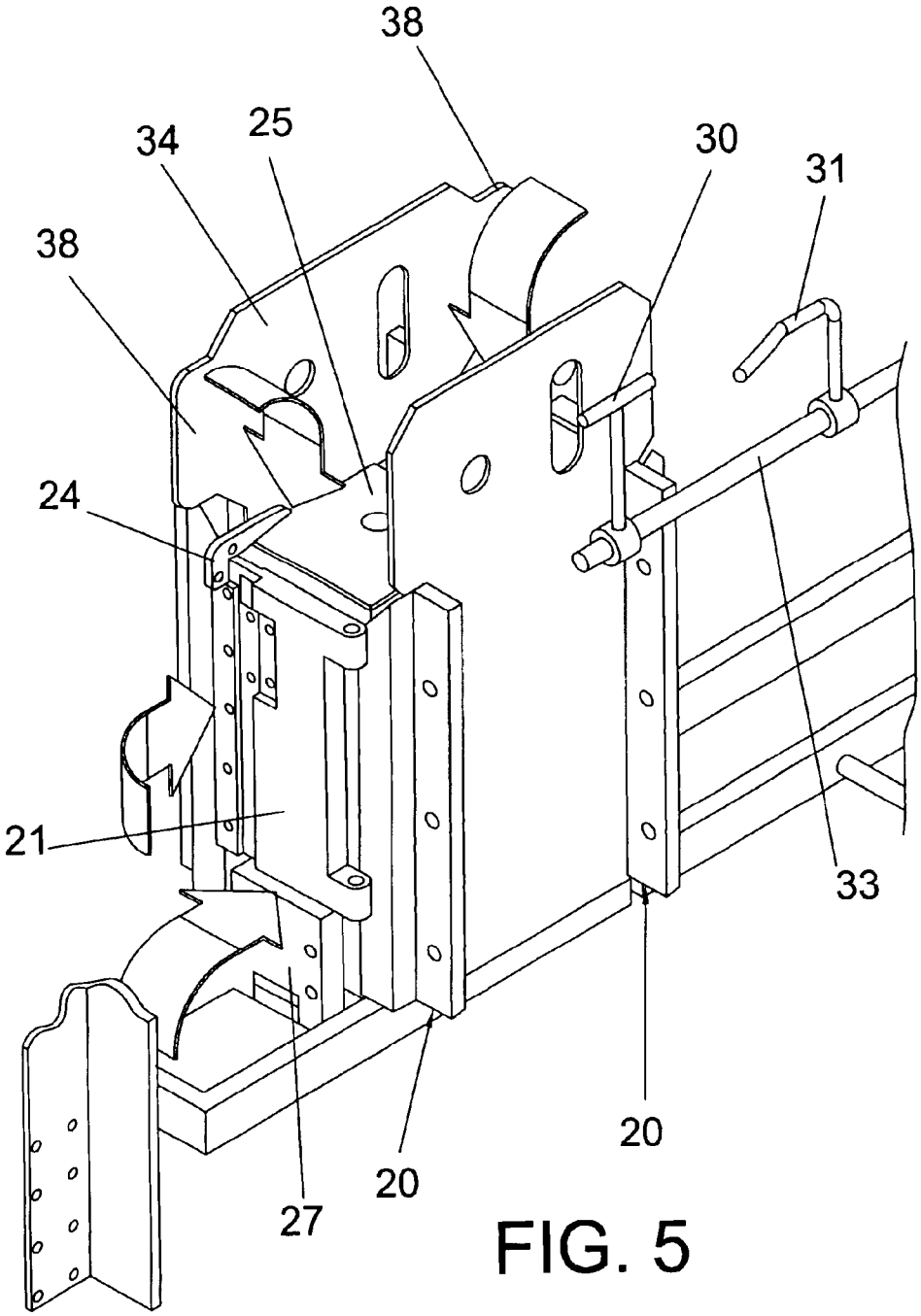
Figure 6:
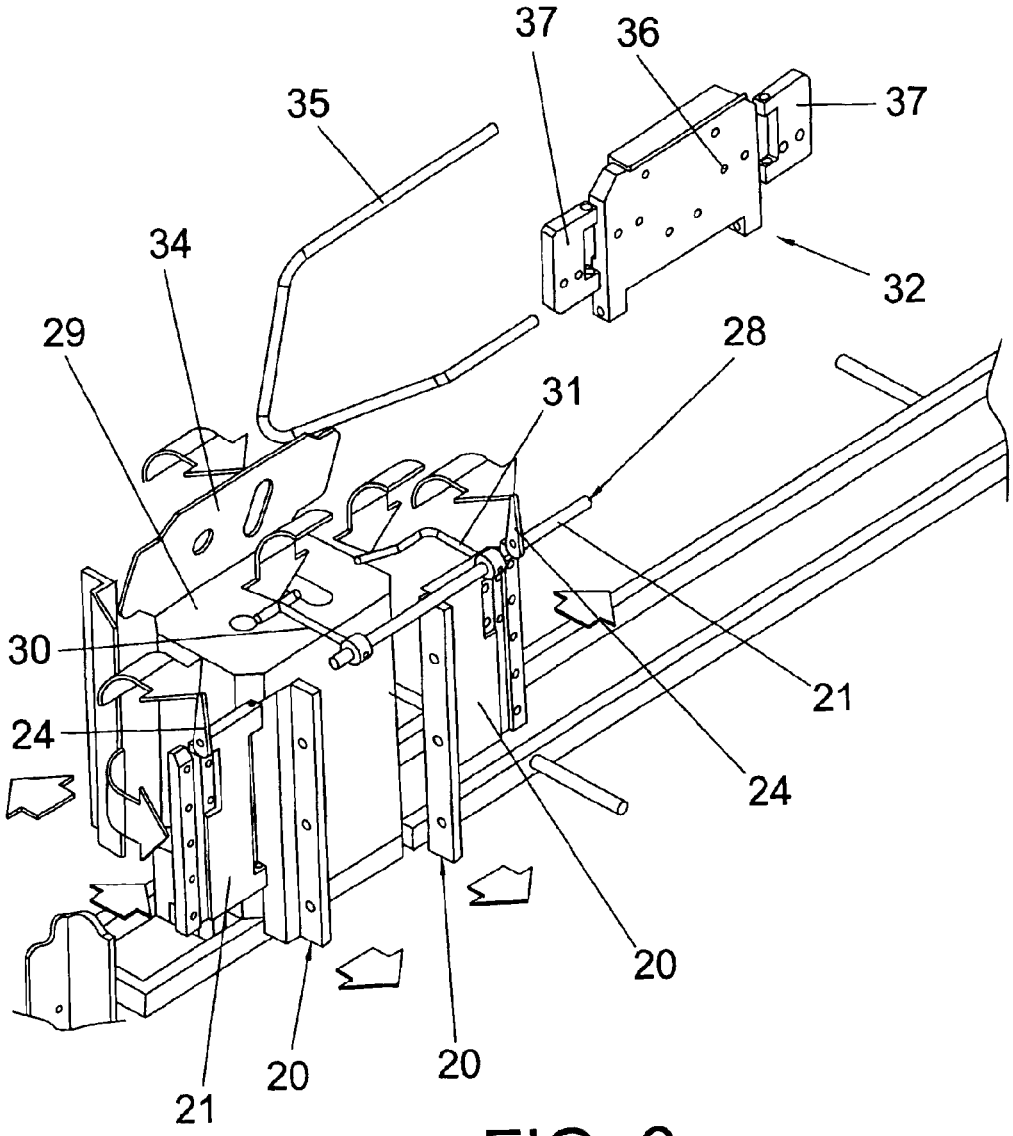
Figure 7:
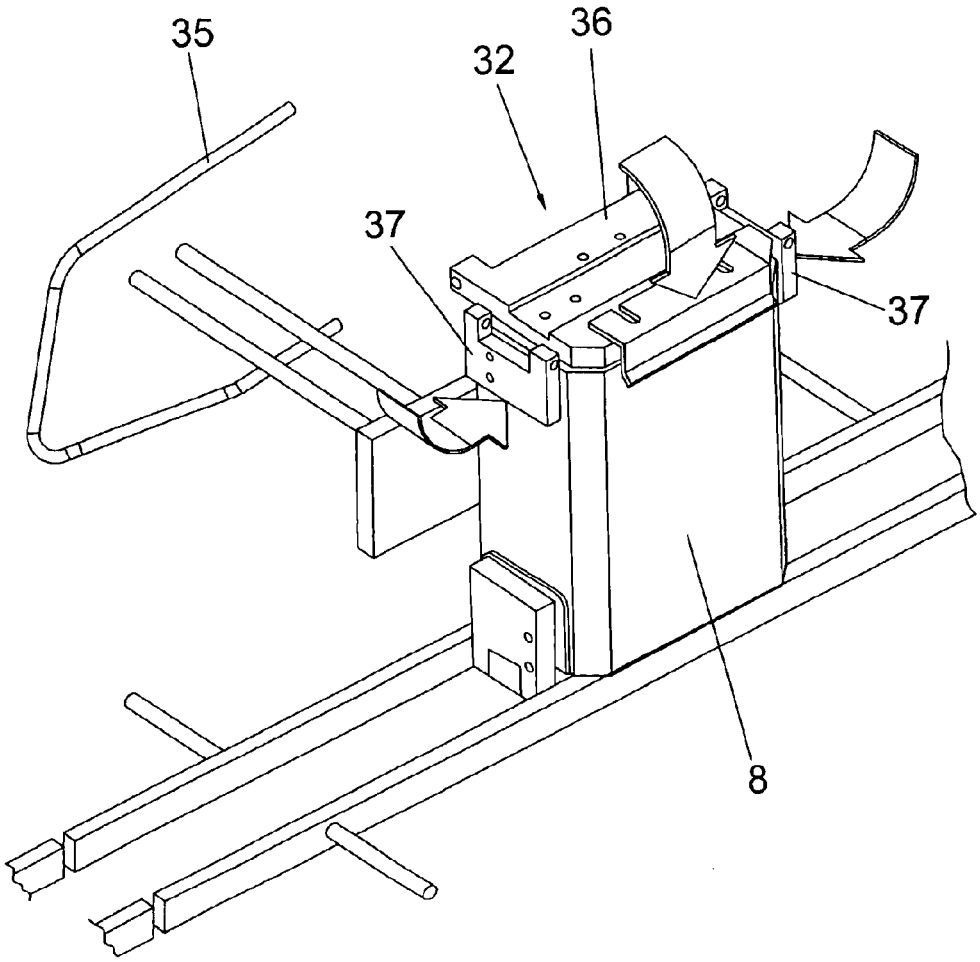
FIG. 7 shows a perspective view of one of the final phases where the box is already completely assembled with the bottles inside.
Figure 8:
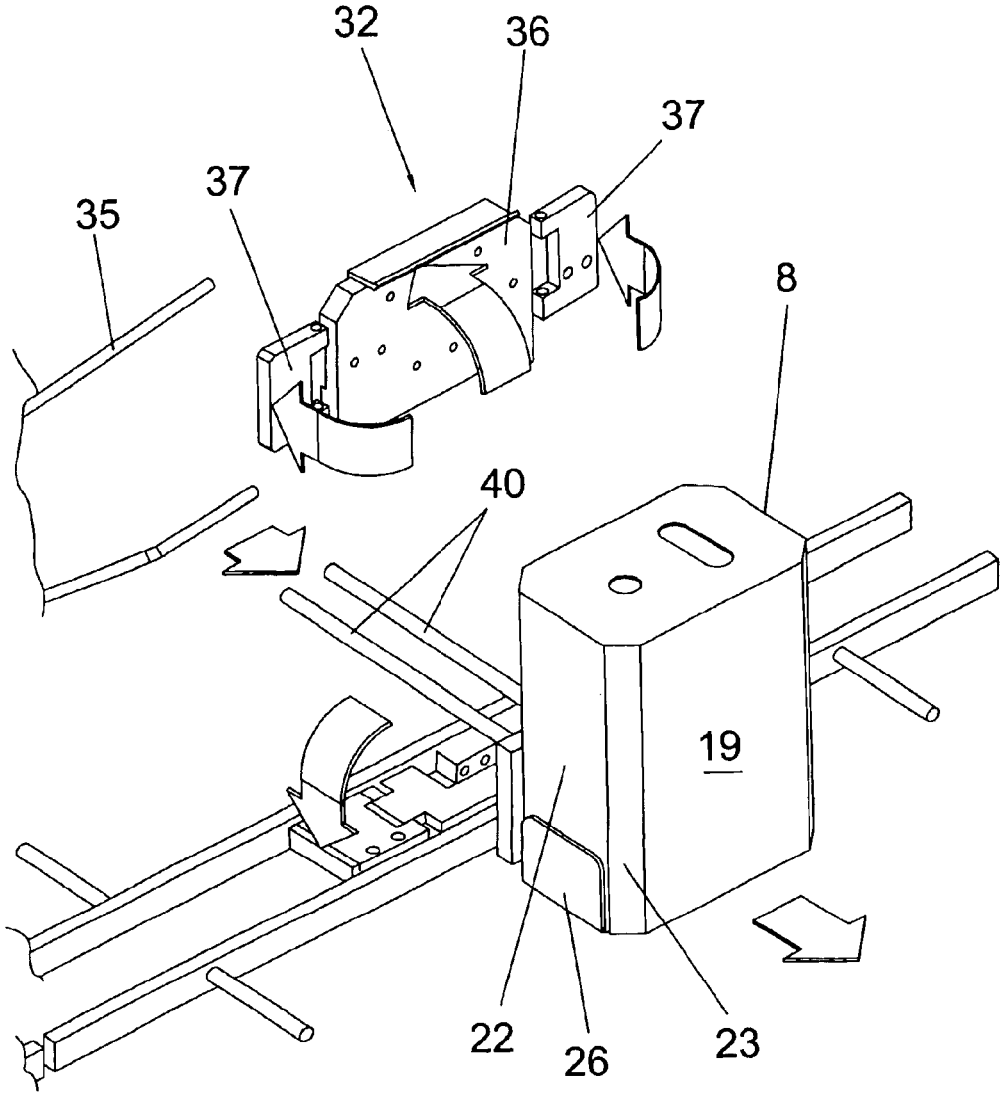
FIG. 8 is a perspective view of the final phase where the assembled box with its content is ejected by means of a pusher.
Figure 9:
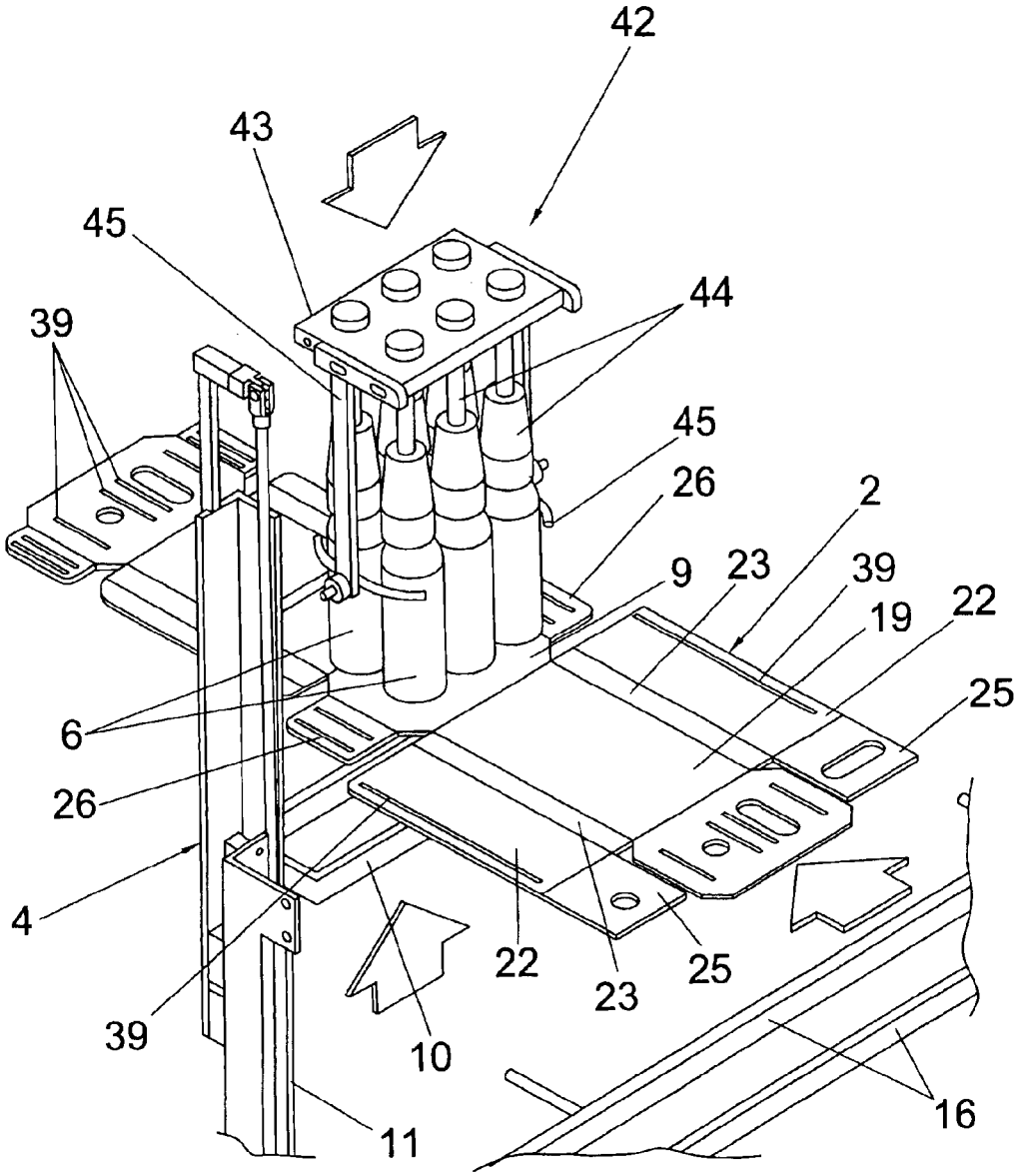
FIG. 9 represents a perspective view where a second option for placement and centering of each group of bottles in one of the initial phases is shown.

The box (8) has been previously glued in its unfolded position (FIG. 2, on some adhesive strips (39), said box (8) acquiring once it has been assembled a consistency that automatically permits the stage of removal from the container (8) completely reinforced with the bottles contained inside therein.

For this purpose, the total closing device (32) returns to its original position, at the same time that the conveyor platform (15) releases the box from its bottom part so that a pusher (40), that moves the box transversally and removes it from the corresponding conveyor belt, comes into operation. Each conveyor belt corresponds with each one of the two longitudinal guides (16), withdrawing it towards an ordinary conveyor belt (5).

On the other hand, the possibility of including a U-shaped support (41) with its free ends diverging outward that ensure the perfect centering of each group of bottles (6) in the initial phase on the base (9) of the container (8) in an unfolded state, has been provided for. When the initial descent of the unfolded sheet (2) with the bottles (6) begins, this support (41) will adopt a vertical position.

On occasions it is important to use this U-shaped support (41) since if the group of bottles is not located exactly on the base of the box, assembly thereof will be defective.

Finally, it should be pointed out that this machine includes an entire series of sensors and electronic control devices in order to automate and control each and every one of the above-cited movements.

As a second option and alternative to the U-shaped support (41), a device that consists of a conveyor support (42) that gathers each group of the bottles (6) selected on the conveyor belt (7) and conveyed directly until the bottles are placed and centered on the bottom (9) of the unfolded sheet (2), has been provided for.

For this purpose, the support (42) has along with a top base (43) some bottom elements (44) to fasten the bottles by the necks during conveyance until they are placed on the unfolded sheet (2) and some side elements (45) that clamp the group of bottles (6) during conveyance.

This second device is more effective than the first one, since it permits bottles with different shapes, different from those of ordinary cylindrical bottles, to be handled.

The conveyor support (42) and all the other elements (44, 43, etc.) are also common to the first option (U-shaped support (41)). The difference is in the side elements (45) that would replace the support (41).

What is claimed is:

1. A machine for packing bottles in cardboard boxes, said machine comprising:

a device for feeding an unfolded sheet of cardboard with adhesive strips thereon;

a device for feeding a group of bottles;

a descending device that receives and supports said unfolded sheet of cardboard and said group of bottles fed onto a central part or bottom of the cardboard sheet, said descending device comprising a U-shaped horizontal support including a pair of branches, said horizontal support movable vertically by means of a pneumatic cylinder, the side walls of the unassembled box in an unfolded position resting on the branches of said horizontal support;

a U-shaped guide located under the horizontal support, wherein when the horizontal support moves downward together with the bottles, the unfolded sheet makes contact with the U-shaped guide and due to the weight of the bottles, the unfolded sheet is partially assembled into a box that remains inside the U-shaped guide;

a movable conveyor platform located under the U-shaped guide, wherein the bottom of the partially assembled box sits on the platform after being introduced inside the U-shaped guide;

a plurality of longitudinal guides on which the movable platform and partially assembled box are conveyed;

a plurality of forming devices positioned adjacent to said U-shaped guide and on both sides of the longitudinal guides for forming at least smaller side walls or front ends of the partially assembled box, when the partially assembled box is inside the U-shaped guide, wherein the forming devices are movable toward one another in a direction transverse to the longitudinal guides;

a plurality of collapsible lugs associated with the forming devices for inwardly folding top end laps of a mouth of the partially assembled box, the top end laps originating from the front ends of the unassembled box;

an arm mechanism positioned adjacent to the longitudinal guides for collapsing a first larger lap of the mouth of the partially assembled box when the partially assembled box is conveyed on the longitudinal guides by the platform; and a total closing device located at a forward position from the U-shaped guide for completing the assembly of the box by collapsing a second larger lap that abuts against the first larger lap after the partially assembled box has been conveyed out of the U-shaped guide.

2. The machine for packing bottles in cardboard boxes, according to claim 1, further comprising a centering device, said feeding device conveying said group of bottles onto the unfolded sheet with said group of bottles being centered on the central part or bottom of the unfolded sheet by means of said centering device.

3. The machine for packing bottles in cardboard boxes, according to claim 2, wherein the centering device comprises a U-shaped support having a cross-member and a pair of branches between which each group of bottles is located.

4. The machine for packing bottles in cardboard boxes, according to claim 2, wherein the centering device comprises a conveyor support that conveys each group of bottles to the unfolded sheet.

5. The machine for packing bottles in cardboard boxes, according to claim 4, wherein the conveyor support comprises:

a top base;

a plurality of bottom elements for fastening and anchoring the bottles by their necks during conveyance; and a plurality of side elements for clamping the group of bottles during their conveyance to the unfolded sheet.

6. The machine for packing bottles in cardboard boxes, according to claim 1, further comprising a fixed folded guide that starts the folding of said second larger lap during the advance of the movable conveyor platform along the longitudinal guides when the partially assembled box is conveyed from the area where the U-shaped guide is located toward said forward position along the longitudinal guides where the total closing device is located.

7. The machine for packing bottles in cardboard boxes, according to claim 1, wherein the U-shaped guide comprises at least:

two horizontal strips facing each other;

a plurality of vertical strips connected to the horizontal strips and extended downward; and a plurality of forming elements arranged above the horizontal strips and connected thereto, and wherein said plurality of forming elements include a plurality of central elements that have a slant outward and end elements that help to form corner extensions of the box during introduction thereof into said U-shaped guide, and wherein said forming elements form the mouth of that U-shaped guide.

8. The machine for packing bottles in cardboard boxes, according to claim 1, wherein each one of the forming devices of the side walls of the box comprises a support, and further comprising a movable part hingedly joined to each forming device that carries out the positioning of at least the front ends of the unassembled box.

9. The machine for packing bottles in cardboard boxes, according to claim 8, wherein the collapsible lugs are coupled to the movable parts of the forming devices.

10. The machine for packing bottles in cardboard boxes, according to claim 1, wherein the arm mechanism comprises:

a collapsible longitudinal rod;

a front arm integral to the rod for collapsing the first larger lap of the mouth of the box; and an elbowed arm integral to the rod with an inclined end section that maintains the first larger lap folded during conveyance of the box when it is removed from the inside of the U-shaped guide.

11. The machine for packing bottles in cardboard boxes, according to claim 1, wherein the movable platform includes movable end parts for collapsing bottom end laps against the front ends of the unassembled box, when the unassembled box is located inside the U-shaped guide, wherein the end laps originate from the bottom of the unassembled box.

12. The machine for packing bottles in cardboard boxes, according to claim 1, wherein the total closing device comprises:

a jointed central plate for collapsing the second larger lap of the mouth of the box; and a plurality of end folding elements that in turn articulate with said central plate, and said elements folding tongues connected to the second larger lap which abut against the front ends of the box.

* * * * *